United States Patent [19]

Neff et al.

[11] 4,150,355

[45] Apr. 17, 1979

[54] ELECTRICAL SPLICES FOR WIRE WOUND RESISTORS

[75] Inventors: Nelson E. Neff, Hershey; Charles E. Reynolds, Mechanicsburg, both of Pa.

[73] Assignee: AMP Incorporated, Harrisburg, Pa.

[21] Appl. No.: 866,873

[22] Filed: Jan. 4, 1978

[51] Int. Cl.[2] ..... H01C 1/148

[52] U.S. Cl. ..... 338/332; 174/84 C; 338/302

[58] Field of Search ..... 338/266, 268, 272, 265, 338/322, 323, 332, 324, 302, 267, 296, 270; 174/94 R, 74 R, 75 R, 84 C; 339/276 R, 276 T; 29/505, 509

[56] References Cited

U.S. PATENT DOCUMENTS

| | | | |
|---|---|---|---|
| 1,936,869 | 11/1933 | Deaver | 174/84 C |
| 2,748,456 | 6/1956 | Berg | 29/193.5 |
| 2,966,649 | 12/1960 | Hayman | 338/322 |
| 3,200,190 | 8/1965 | Forney, Jr. | 174/84 C X |
| 3,330,903 | 7/1967 | Holke et al. | 174/94 R |
| 3,370,122 | 2/1968 | Ichikawa | 174/94 R X |
| 3,395,452 | 8/1968 | Hummel | 338/266 X |
| 3,521,215 | 7/1970 | O'Keeffe | 338/332 |

*Primary Examiner*—C. L. Albritton
*Attorney, Agent, or Firm*—Frederick W. Raring

[57] ABSTRACT

Stamped and formed connecting device for splicing a small diameter lead wire to a larger diameter resistor core comprises a U-shaped connecting member having a web and sidewalls. The web has a semicylindrical central depression for the lead wire and has arcuate portions on each side of the depression which conform to the resistor core. The sidewalls are reversely folded at their outer ends to provide inner and outer layers. The ends of the inner layers are located adjacent to the depression. In use, the lead wire is located in the depression, the resistor core is positioned between the sidewalls, and the sidewalls are crimped onto the resistor. The ends of the inner layers move relatively towards, and against, the lead wire during crimping and establish contact with the lead wire. Contact with the resistor core is established by the inner surfaces of the inner layers of the sidewalls.

5 Claims, 6 Drawing Figures

ELECTRICAL SPLICES FOR WIRE WOUND RESISTORS

BACKGROUND OF THE INVENTION

This invention relates to electrical connections or splices for wire wound resistors of the type comprising a cylindrical core of insulating material and a resistance wire wound helically over the core. A commonly used type of splice connection is disclosed in U.S. Pat. No. 2,748,456 and a machine for applying these slices to resistors is shown in U.S. Pat. No. 2,673,345.

The splicing device shown in the above identified U.S. Pat. No. 2,748,456, is widely used and has proved to be widely successful however, under some circumstances there is a requirement for a splicing device having improved characteristics in certain aspects. The prior art splicing device referred to above comprises a simple sheet metal U-shaped member which is crimped onto the wire wound resistor so that the internal surfaces of the connecting device contacts the helically wound wire on the resistor core. The lead wire is positioned on the surface of the resistor with its axis extending parallel to the axis of the resistor. After crimping, the lead wire is gripped between the edges of the sidewalls in the crimped connecting device. The edges of the connecting device thus contact the lead wire and the internal surface of the contacting device contacts the resistance wire on the resistor.

In accordance with the principles of the instant invention, a U-shaped connecting device is provided which has a semi-cylindrical depression in its web which conforms to, and receives, the lead wire. The sidewalls are reversely folded at their outer ends to provide an inner layer or thickness of metal in each sidewall. The inner layer extends along the internal surface of the outer layer towards the web. The ends of the inner layers are swaged to facilitate electrical contact with the lead wire. When the connecting device is crimped onto the resistor, the sidewalls are folded into surrounding and embracing relationship with the resistor core and the inner layers are displaced towards the web relative to the outer layers. The ends of the inner layers are thus moved against the lead wire to establish contact therewith.

It is accordingly an object of the invention to provide an improved splicing device for wire wound resistors. A further object is to provide a crimped connection between a wire wound resistor and a lead wire having improved electrical and mechanical connections between the lead wire and the connecting device.

These and other objects of the invention are achieved in a preferred embodiment thereof which is briefly described in the foregoing abstract, which is described in detail below, and which is shown in the accompanying drawing in which:

FIG. 3 is a view of an uncrimped connecting device in accordance with the invention.

Figure 1:
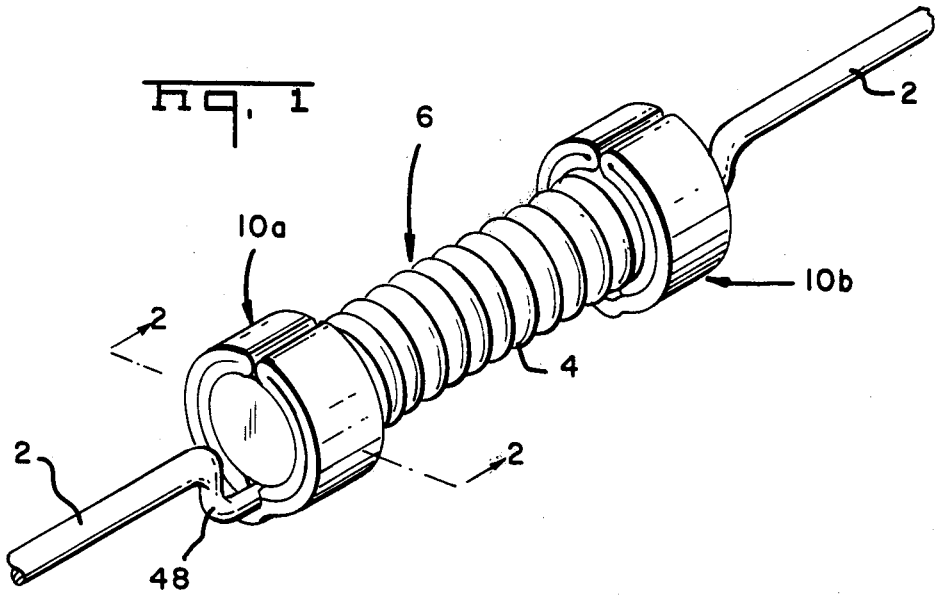
FIG. 1 is a perspective view of a wire wound resistor having lead wires connected thereto in accordance with the invention.
Figure 2:
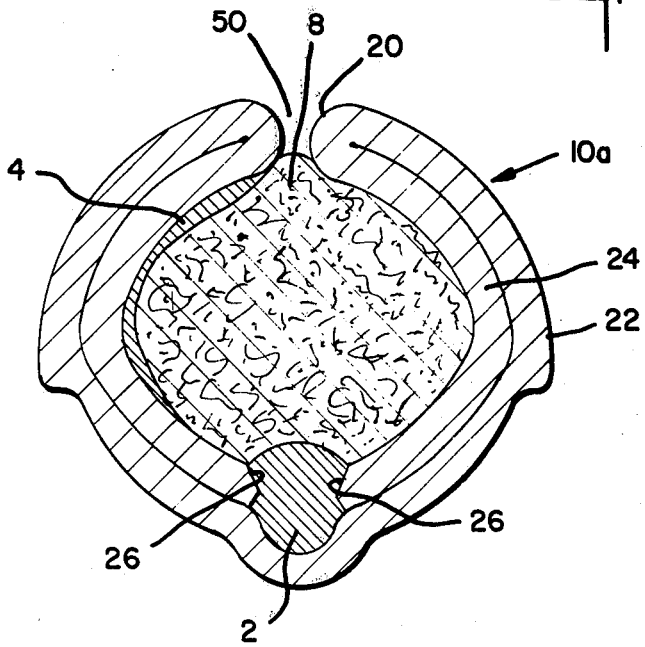
FIG. 2 is a cross sectional view of a crimped connection between a lead wire and a resistor taken along the lines 2—2 of FIG. 1.

As shown in FIG. 1, the invention is directed towards the achievement of splice connections between lead wires 2 and the relatively fine helically wound wires 4 on a wire wound resistor 6. The resistor comprises a cylindrical core 8 of insulating material around which the resistance wire 6 is wound from one end thereof to the other end. The core may be of any suitable insulating material, and fiberglass is commonly used, particularly for relatively small resistors as will be described below. The connecting devices 10 which serve to connect the lead wires 2 to the resistor core are crimped onto the ends of the resistor core as shown in FIG. 2 with the sidewalls of the connecting device in surrounding relationship to the core 8 and with the lead wires disposed on the web of the connecting device.

Referring now to FIG. 3, an uncrimped connecting device 10 comprises a web 12 having sidewalls 14 extending therefrom. The web 12 has centrally located semi-cylindrical depression 16 therein which has a radius which conforms to the radius of the lead wires for which the device is intended. The radii of the depression 16 and the lead wire need not be precisely the same but should be such that the lead wire will nest in the depression and will extend above the internal surfaces of the adjacent web portions 18. These adjacent web portions 18 are also arcuate on semi-cylindrical and are dimensioned to conform generally to the cross-section of the resistor core 8. The sidewalls 14 have outer or free ends 20 which are reversely folded as shown so that each sidewall comprises outer and inner layers or metal thicknesses 22, 24 respectively. The inner layer is against the outer layer 22 and extends downwardly to the web 18 so that the ends 26 of these inner layers are disposed on each side of the depression 16.

Figure 4:
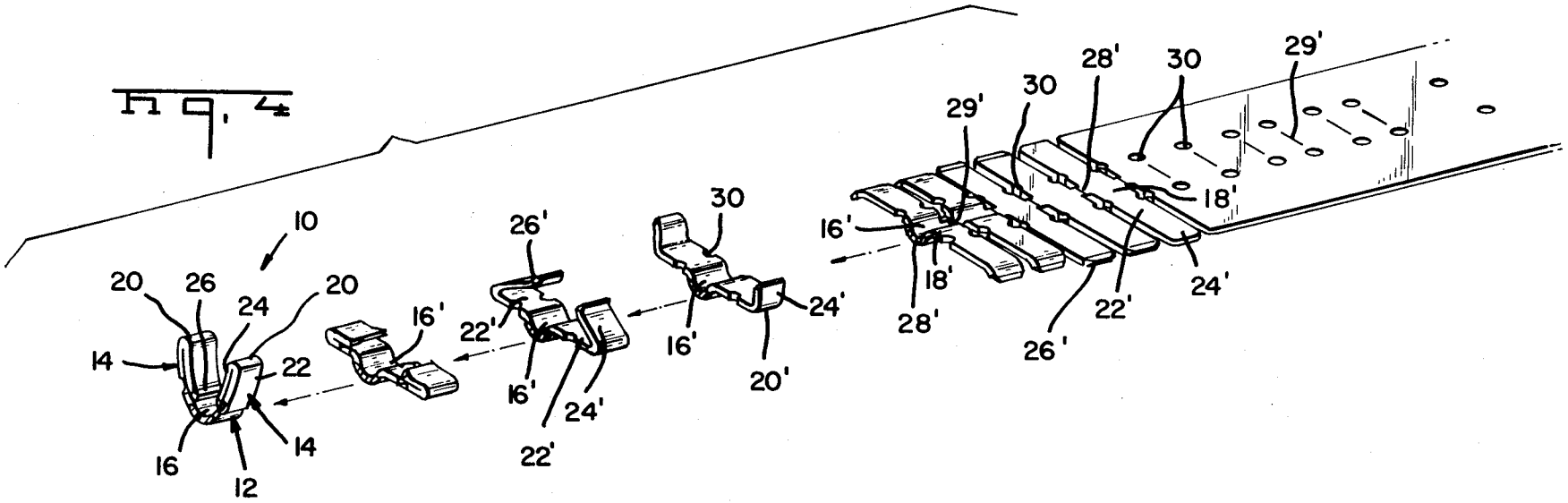
FIG. 4 is a view of the progression showing the stages in the manufacture of connecting devices in accordance with the invention.

Connecting devices in accordance with the invention are manufactured by stamping and forming methods and are preferably produced in a forming die which carries out several forming operations illustrated in FIG. 4. It will thus be seen that a continuous strip of sheet metal is first blanked and provided with pilot holes 30 by means of which the strip is fed into and through the stamping and forming die. In FIG. 4, the parts of the blank and the partially formed connecting devices are identified with the same reference numerals, differentiated by prime marks, as those used above with reference to the finished connecting device of FIG. 3. It will be seen that during forming, the flat blanks are first swaged at their outer ends 26′ and the outer ends are then formed downwardly as viewed in the drawing. Each blank is then folded at 20′ do define the outer and inner metal thicknesses 22′, 24′. The inner thickness 24′ is bent downwardly against the outer thickness of each side of the centerline of the strip and the sidewalls 14′ are then formed upwardly to produce the finished strip of connecting devices. The central depression 16 is produced at the same time as the initial forming operation on the outer ends 20′ of each blank and the strip is notched as shown at 29′ between adjacent blanks so that each connecting device can be severed easily from the next adjacent connecting device when the strip is fed into the crimping machine. The connecting sections 28′ are extremely short as shown in FIG. 4, and very little sheet metal material is wasted during manufacture of the connector strip.

Figure 5:
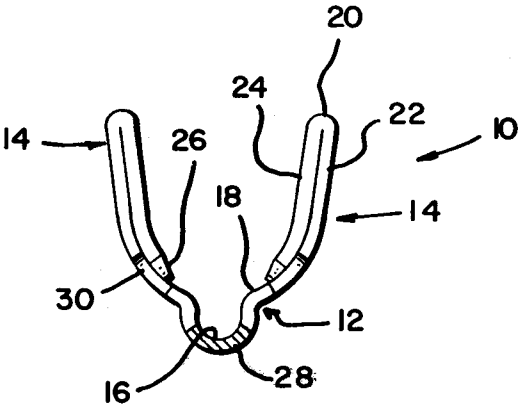
FIG. 5 is a frontal view of an enlarged scale showing a crimping die and anvil for crimping the connector of FIG. 3 onto a resistor and a lead wire.
Figure 7:
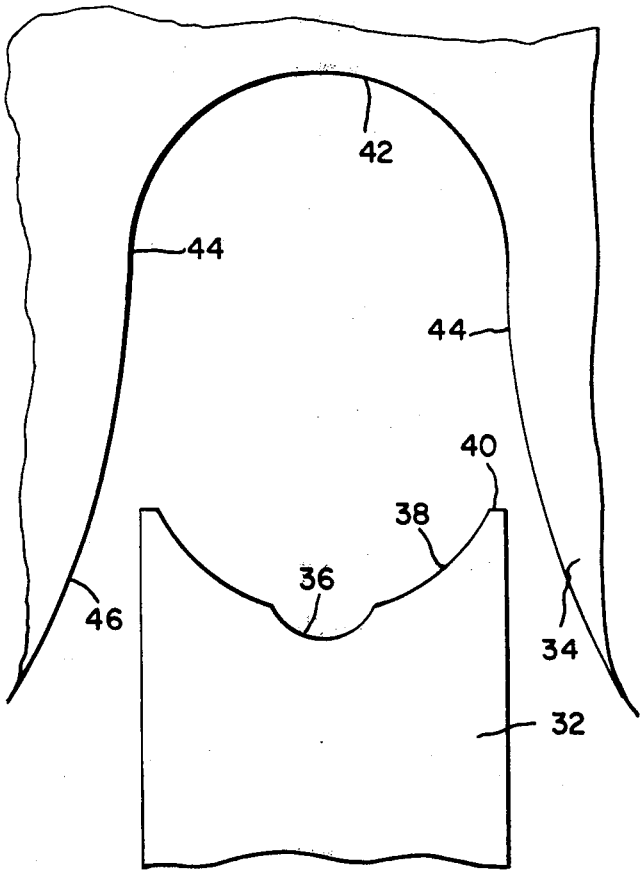

Connecting devices in accordance with the invention are advantageously crimped onto resistors by means of a suitable crimping apparatus of a general type disclosed in U.S. Pat. No. 2,673,345. The crimping tooling for the present connecting device, FIGS. 5 and 6, used in the apparatus comprises a lower tool or anvil 32 and a crimping die 34. The anvil 32 has a supporting surface which has a centrally located arcuate section 36 of relatively short radius, adjacent arcuate sections 38 which have a radius which is greater than that of section 36, and flat ledges 40 adjacent to the sides of the anvil. The central arcuate section 36 receives the external surface defined by the depression 16 and the arcuate surface 38 supports external surface portions of the web and sidewalls during crimping. The crimping die 34 has a centrally located cylindrical surface 42 at the inner end of the die cavity which merges with downwardly extending surfaces 44. The surface 44 in turn merges with the divergent surfaces 46 having a relatively large radius.

Figure 6:
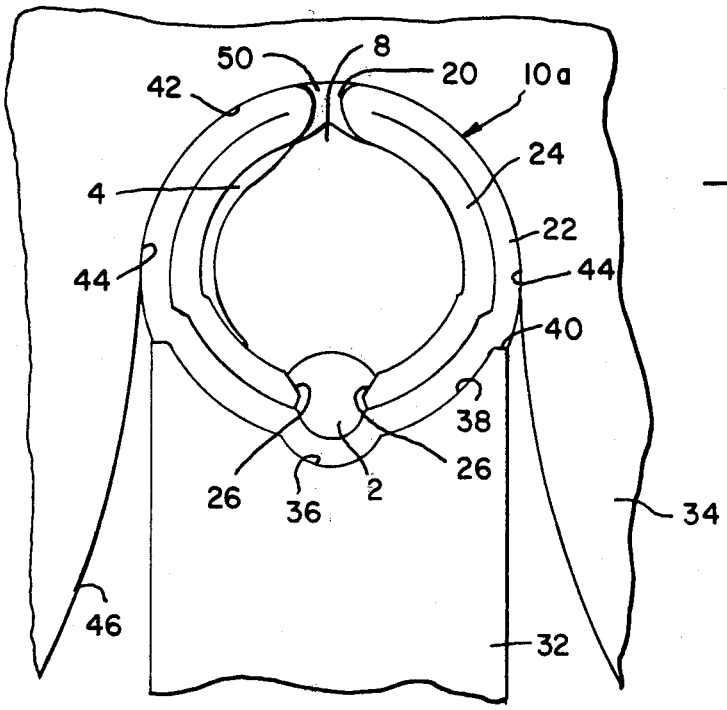
FIG. 6 is a view similar to FIG. 5 but showing the die and anvil in their closed positions and showing a connector therebetween.

In use, a connecting device is positioned on the anvil, a lead wire 2 is positioned in the recess 16 and a resistor core 8 in positioned between the sidewalls of the connecting device. Thereafter, the crimping die and anvil 32, 34 are moved relatively towards each other to their fully closed positions as shown in FIG. 6. During such movement, the sidewalls 14 are formed inwardly towards each other and into surrounding relationship with the resistor so that portions of the resistor wire 4 come into contact with the internal surface portions of inner layer 24 as shown in FIG. 6. The forming of the sidewalls causes the inner thicknesses or layers 24 to move relatively towards the depression 16 for the reason that the inner layers of metal 22, 24 have a significantly smaller radius than the outer layers 22 in the crimped connection. As a result of this movement of the inner metal thicknesses, the swaged ends 26 are moved against, and into electrical contact with, the lead wire 2. As illustrated in FIG. 2, the lead wire is substantially deformed during crimping and is tightly held between the ends 26 so that excellent mechanical and electrical connections are achieved between the lead wire and the connecting device. As illustrated in FIG. 1, portions 48 of the lead wires which are adjacent to the resistor core may be offset inwardly so that the lead wires and the resistor core all have a common axis.

Some of the salient advantages of the invention will be apparent from a reading of the foregoing description. The lead wire is buried in the crimped connection and is diametrically opposite to the open seam 50 as shown in FIG. 2. The electrical and the mechanical connection of the lead wire to the connecting device is thus provided with a maximum amount of protection from the atmosphere and from external forces or influences. A relatively wide range of lead wires and resistor cores can be accommodated in one size of terminal and it is not necessary that the lead wire and resistor core lie within close and exacting tolerances. In other words, a given connecting device in accordance with the invention will accept and establish good electrical and mechanical contact with resistor cores and lead wires which are not within closely controlled tolerances.

The principles of the invention can be used for connecting devices of a wide range of sizes and each size is capable of accommodating a range of resistor core sizes. However, it should be noted that connecting devices in accordance with the invention can be produced in relatively small sizes for use with small size resistor cores. For example, a connecting device, in accordance with the invention, having a width between sidewalls of about 0.210 inches and an overall height of about 0.2 inches can be used to connect lead wires having a diameter of about 0.033 inches to resistor cores having diameters in the range of 0.1 inches to 0.14 inches.

What is claimed is:

1. A stamped and formed connecting device for connecting a relatively small diameter lead wire to a relatively large diameter core of a resistor, said connecting device comprising:

a generally U-shaped member having a web and sidewalls extending from said web, said web having a centrally located depression extending axially therein, said sidewalls having outer ends, each of said sidewalls being reversely folded at said outer ends whereby each of said sidewalls comprises an inner layer and an outer layer, said inner layer of each sidewall extending to said web and having an end which is located adjacent to said depression whereby, upon locating said lead wire in said depression, positioning said resistor core on said lead wire and between said sidewalls, and crimping said connecting device onto said resistor core by bending said sidewalls towards each other and into constrictive embracing relationship with said resistor core, said ends of said inner layer move against, and establish electrical contact with, said lead wire, and internal surface portions of said inner layer establish electrical contact with said resistor core.

2. A stamped and formed connecting device as set forth in claim 1, said device being substantially symmetrical about a vertical axis extending through said depression and between said sidewalls.

3. A stamped and formed connecting device as set forth in claim 1, said depression being semi-cylindrical and having a radius which conforms to the radius of said lead wire.

4. A stamped and formed connecting device as set forth in claim 1, said ends of said inner layers being tapered to facilitate contact with said wire.

5. A stamped and formed connecting device as set forth in claim 1, said depression being semi-cylindrical and having a radius which conforms to the radius of said lead wire, said web being semi-cylindrical and having a radius which conforms to the radius of said resistor core.

* * * * *